US006766590B2

(12) United States Patent
Altamore et al.

(10) Patent No.: US 6,766,590 B2
(45) Date of Patent: Jul. 27, 2004

(54) HAND HELD DRYING DEVICE

(75) Inventors: Nicolo Altamore, Rockford, IL (US); James E. McCambridge, Polo, IL (US)

(73) Assignee: Wahl Clipper Corporation, Sterling, IL (US)

( * ) Notice: Subject to any disclaimer, the term of this patent is extended or adjusted under 35 U.S.C. 154(b) by 0 days.

(21) Appl. No.: 10/195,747

(22) Filed: Jul. 15, 2002

(65) Prior Publication Data

US 2004/0006885 A1 Jan. 15, 2004

(51) Int. Cl.[7] ..... F26B 19/00; A45D 20/02
(52) U.S. Cl. ..... 34/96; 34/97
(58) Field of Search ..... 34/90, 96, 97, 34/60; 392/379, 380, 383, 384, 385

(56) References Cited

U.S. PATENT DOCUMENTS 1,455,034 A * 5/1923 Small ..... 34/97
4,039,774 A * 8/1977 Kata et al. ..... 219/370
5,344,314 A * 9/1994 Zagoroff et al. ..... 432/222
5,507,103 A * 4/1996 Merritt ..... 34/97
5,555,637 A * 9/1996 Montagnino ..... 34/97
5,875,562 A * 3/1999 Fogarty ..... 34/97
6,148,537 A 11/2000 Altamore ..... 34/97
6,285,828 B1 * 9/2001 Cafaro ..... 392/385

FOREIGN PATENT DOCUMENTS

GB 2083745 A * 3/1982 ..... A45D/20/10
GB 2183154 A * 11/1986 ..... A45D/20/12

* cited by examiner

*Primary Examiner*—Kenneth B Rinehart
(74) *Attorney, Agent, or Firm*—Greer, Burns & Crain, Ltd.

(57) ABSTRACT

A hand held drying device has a body with a front air outlet. A heater, motor and fan are contained in the body. A shroud covers at least a portion of the body, with at least one passage defined between the shroud and the body for communicating air to the fan from at least one air inlet. The shroud reduces the level of noise generated when operating the drying device.

11 Claims, 5 Drawing Sheets

HAND HELD DRYING DEVICE

BACKGROUND OF THE INVENTION

The present invention relates to hand held drying devices. More particularly, the present invention is related such devices used for drying and/or styling hair, also known as hair dryers.

Hand held dryers such as hair dryers and the like are generally known in the art. Conventional hair dryers may include a generally tubular body mounted on a handle, with a fan, a heater and a motor housed in the tubular body. Air is generally drawn into the tubular body through one or more inlets proximate the rear of the tube, behind the fan. The air is urged by the fan over the heater and out a front outlet of the body. Operation of the motor and fan in driving the air results in noise that escapes the tubular body through its air inlet, air outlet, and through the body walls.

Because a hair dryer is generally proximate a user's ears when used, the generated noise can be a nuisance. In addition to the user, the noise can be a nuisance for others nearby, including professional hair stylists using the devices to style a customer's hair. In a professional setting such as a hair salon or the like, the noise can be particularly troublesome due to the simultaneous use of several hair dryers.

Attempts to reduce hand held dryer noise have been made. For example, commonly assigned U.S. Pat. No. 6,148,537 describes a hand held dryer having a muffler covering the back portion of the dryer and the back air inlet. The muffler provides at least one air intake passage with an opening proximate the front outlet of the tubular body. While the disclosure of the '537 patent offers advantages over prior art dryers in reducing emitted noise, it leaves some problems unresolved.

For example, it has been found that the construction and arrangement of the muffler disclosed in the '537 patent may cause the fan and motor to operate at less than their highest efficiency. The disclosed intake passage of the '537 patent also has a geometry that may limit air intake and flow, and that thereby results in limited fan and motor efficiency. Further, the configuration of the handle and body of the dryer disclosed in the '537 patent may lead to fatigue and discomfort for professional stylists and others that hold the dryer for prolonged periods.

Accordingly, there are unresolved needs in the art. For example, dryers operate with high levels of noise. Also, prior art dryers with mufflers are configured in a manner such that they may operate at less than highest efficiency. Further, handle and body configuration of some dryers may lead to fatigue for users such as professional stylists.

SUMMARY OF THE INVENTION

The present invention is directed to a hand held dryer device. One embodiment of the invention is directed to a dryer device having a body with a front air outlet and a handle attached to the body. The body contains a heater, a motor and a fan. A shroud covers at least a portion of the body, with at least one passage defined between the shroud and the body for communicating air from at least one passage inlet to the fan. The at least one passage inlet has an area that is larger than the front air outlet.

An additional invention embodiment is directed to a dryer device having a body with a front air outlet and a fan intake proximate the back end of the body. A handle is attached to the body. The body contains a heater, a motor and a fan. A shroud covers at least a portion of the body, with at least one passage defined between the shroud and the passage for communicating air to the fan intake. The shroud has an end cap that covers the back end of the body to define a chamber open to the fan intake. At least a portion of a back wall of the chamber is arcuately shaped. In addition, the dryer body is provided with ergonomic formations for reducing user fatigue while holding the dryer for extended periods.

Hand held dryer device embodiments of the invention thereby solve otherwise unresolved problems of the prior art. For example, the shroud surrounding a portion of the body significantly lowers the noise associated with operation of the drying device. Also, an inlet of a larger area than the air outlet provides for improved fan and motor efficiency. An embodiment having a chamber defined between a shroud end cap and a fan intake likewise provides for improved fan and motor efficiency as an arcuately shaped back wall of the chamber improves airflow to the fan.

DETAILED DESCRIPTION

Turning now to the drawings, the hand held drying device or dryer shown generally at 10 has a generally tubular body 12 and a handle 14 attached to the body 12. It will be understood that as used herein the term "tubular" is intended to broadly refer to an elongate, generally round shape with open ends and generally defining an internal space or cavity. Accordingly, the term is not intended to refer to a constant or even a regular outer circumference, diameter or shape. The body 12 is preferably made of a molded plastic selected for durability, appearance, cost, and other like considerations.

Figure 7:
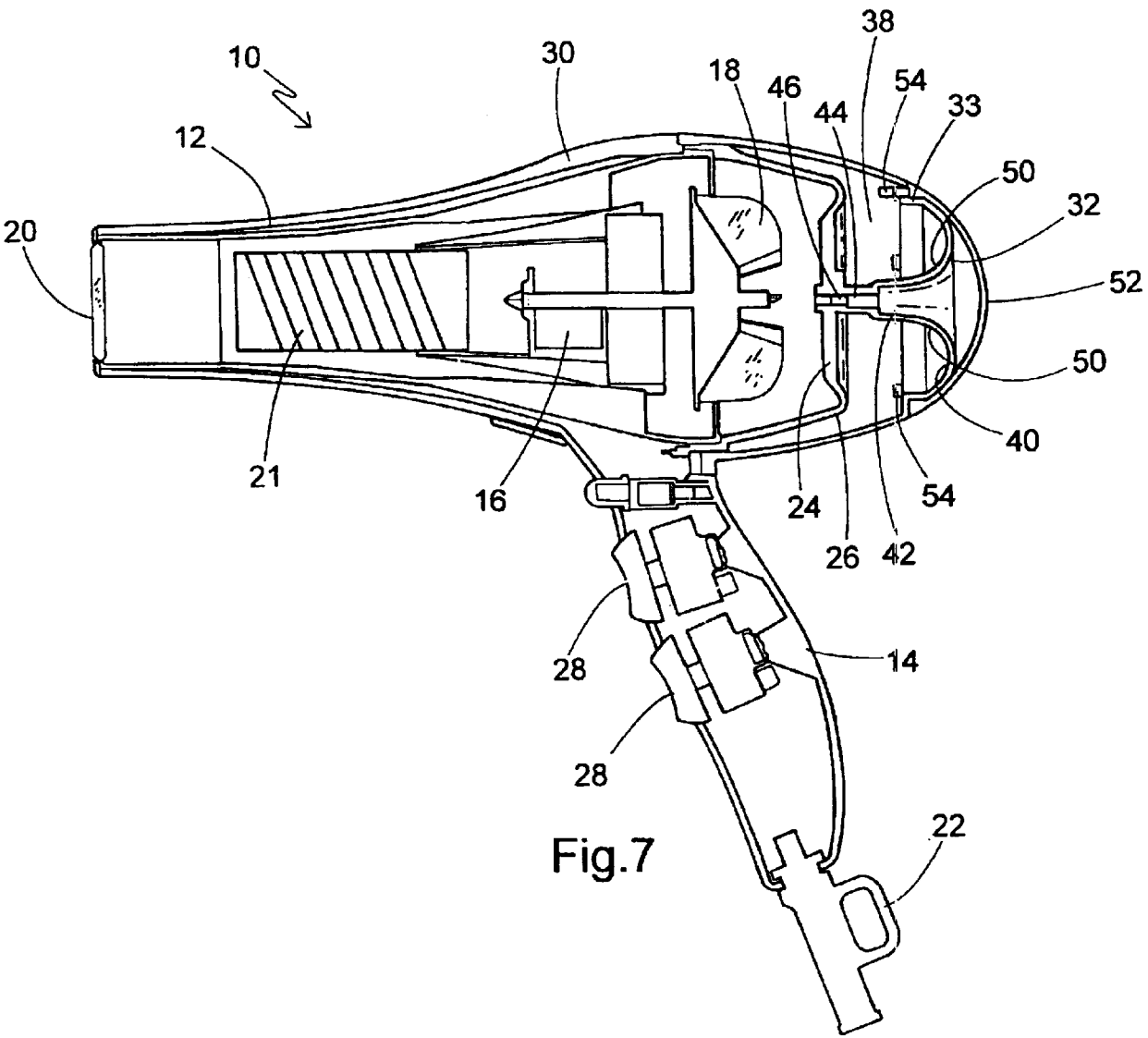
FIG. 7 is a cross-sectional taken along the line 7—7 of FIG. 2 and in the direction indicated generally of the drying device of FIG. 1; and, FIG. 8 is a cross-section of the drying device of FIG. 1 taken along the line 8—8 of FIG. 4 and in the direction indicated generally.
Figure 8:
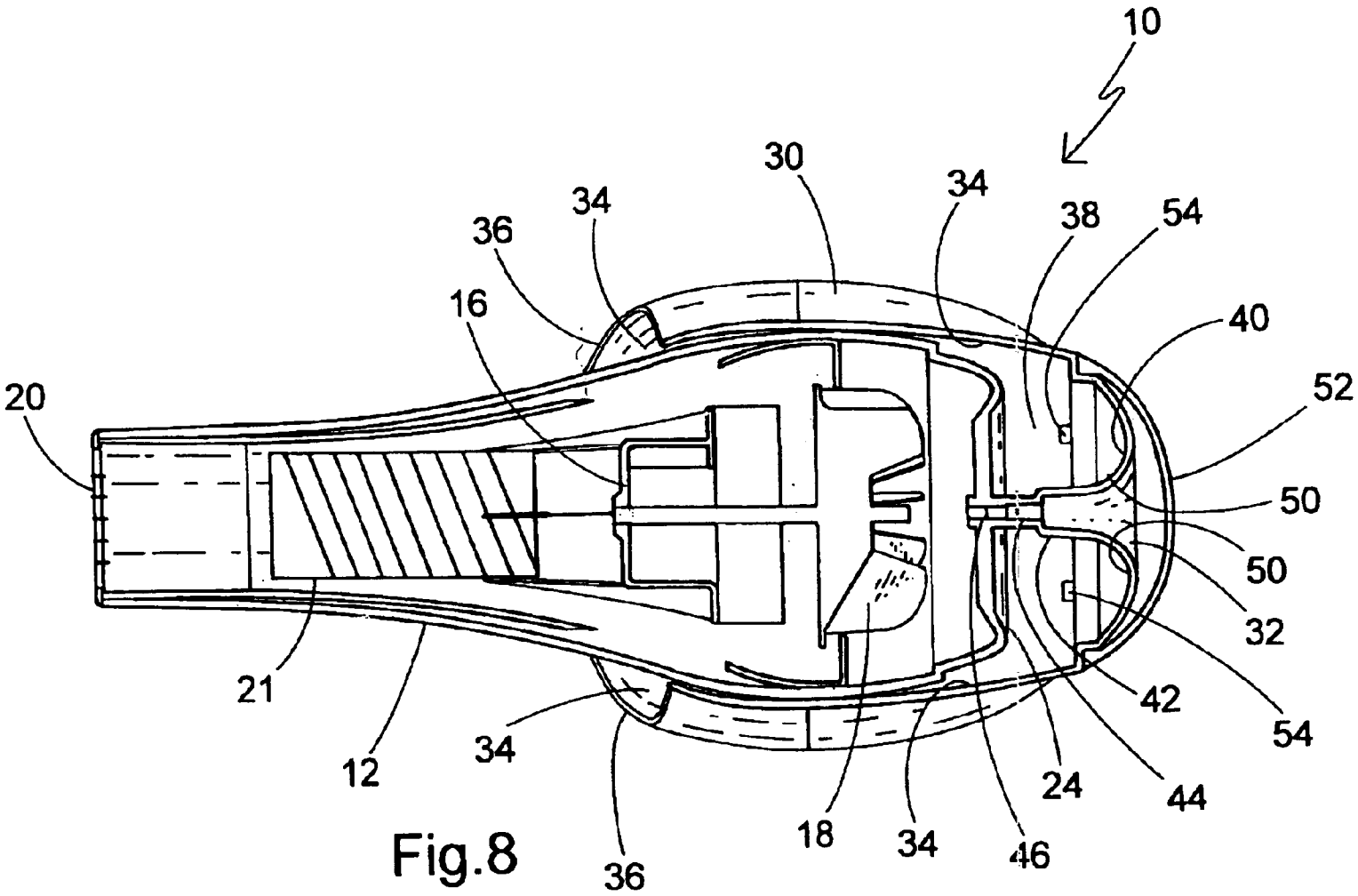

As best shown by the cross-sections of FIGS. 7–8, the body 12 contains a motor 16 connected by a shaft to a fan 18, and has a front air outlet 20. The body 12 also preferably contains at least one heater 21 for heating the air. As is typical in the art, the heater 21 preferably is electric and includes a length of resistor wire disposed along a portion of the length of the body 12 interior forward of the fan 18 and spaced from the interior of the wall. The resistor wire may be wrapped about the perimeter of an electric insulator structure such as a generally cross-shaped mica structure. When current is applied to the resistor wire, it becomes heated and transfers heat to surrounding air. In operation, the motor 16 drives the fan 18 to direct air from a fan intake 24, over the heater 21, and out the front outlet 20. The fan intake 24 is proximate a back end 26 of the body 12.

The motor 16, the fan 18, and the heater 21 may be controlled by one or more switches 28 on the handle 14. As is typical with such devices, one switch 28 controls the fan 18 and the other controls the heater 21. A cord 22 (FIG. 7) may be provided for connection to an external AC or a DC power source. Another dryer embodiment may also contain a DC power supply such as batteries. Those knowledgeable in the art will appreciate that these elements and operational principles are generally typical of dryer devices known in the art. Additional detail regarding other standard and known elements and features of the dryer device 10 will not be further presented herein for the sake of brevity.

Figure 3:
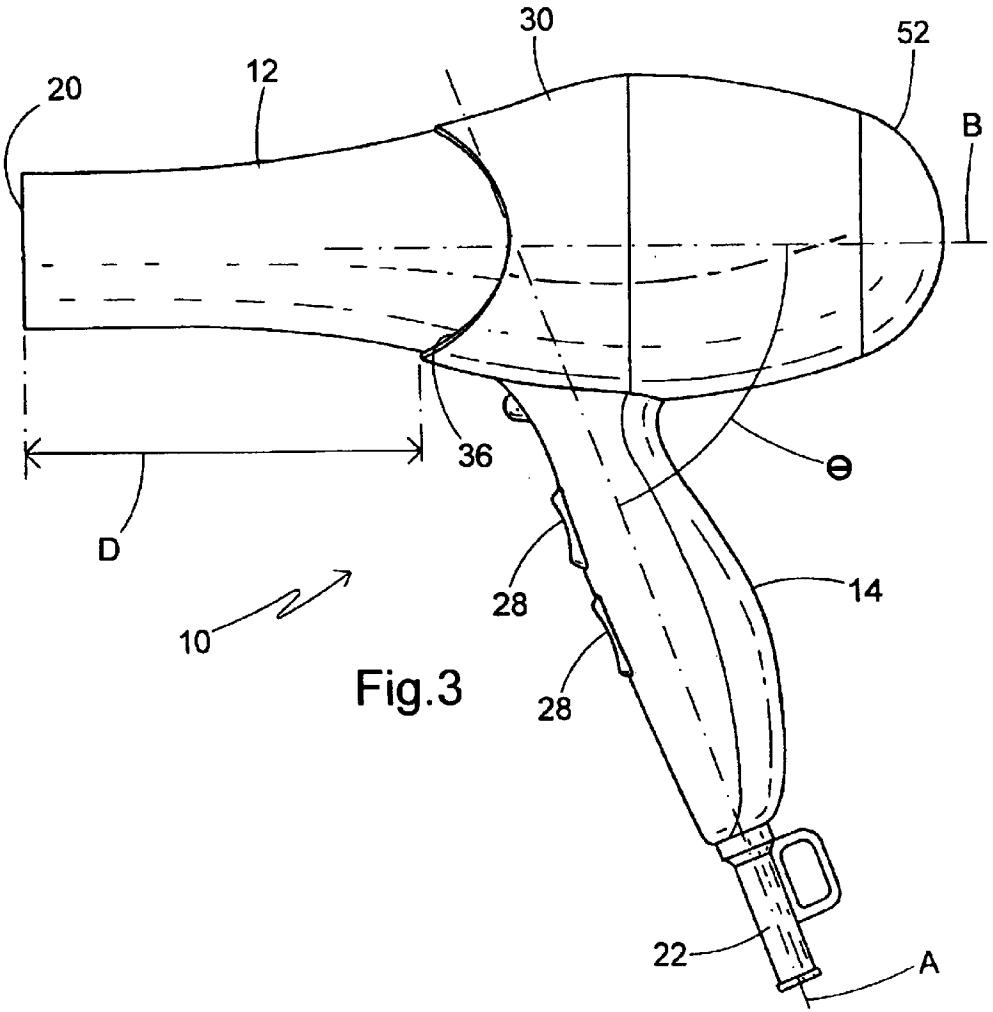
FIG. 3 is a side view of the drying device of FIG. 1.

In addition to these generally known elements, the preferred hand held dryer device 10 further includes a shroud 30 that covers at least a portion of the body 12. The shroud 30 preferably surrounds the perimeter of at least a portion of the generally tubular body 12, and as best illustrated by FIGS. 7–8 includes a shroud end cap 32 that covers the back end 26 of the body. As shown by FIG. 3, the shroud 30 preferably extends over the body to a distance D axially spaced back from the front air outlet 20 by about 5–7 inches. Some embodiments may have an air pocket or another insulative material disposed between the shroud 30 and the body 12 to aid in muffling noise. The shroud 30 is preferably made of a molded plastic, and may be molded in a plurality of individual portions for later assembly for convenience of molding. A passage is provided for receiving the handle 14 that extends through the shroud 30 to the body.

It has been discovered that the shroud 30 significantly reduces the noise emitted during operation of the dryer device 10. The actual level of noise generated may vary depending on such factors as motor power and speed, fan size, emitted air speed, body wall thickness, and the like. By way of reference, tests were conducted using three prior art drying devices (Models A, B and C) and a drying device of the present invention having a shroud (Model D), with the following data obtained:

| Model: | Volt: | Air Speed (m/sec): | Motor RPM: | Pressure (mm $H_2O$) | Max Wattage | Noise (Db) |
|---|---|---|---|---|---|---|
| A | 110 | 14.4 | 11,800 | 110 | 1200 | 68 |
| B | 110 | 18.2 | 15,600 | 200 | 1600 | 72 |
| C | 110 | 15.7 | 17,900 | 190 | 1300 | 74 |
| D | 110 | 17.2 | 14,300 | 210 | 1600 | 64 |

This data indicates that the dryer device of the present invention (Model D) has a lower noise emission than any of the prior art devices tested. While the data does not represent a direct comparison of equals in that Models A, B and C may have had different motor and other configurations than Model D, the RPM, air speed, and wattage data suggest that all of the models are of the same general class and are therefore useful for comparison. Also, it is noted that Model D achieved the highest air speed of the models tested while also producing the lowest noise level. This evidences the noise reduction advantages available through practice of the present invention.

As best illustrated by the sectional views of FIGS. 7–8, two passages 34 are defined between the shroud 30 and the body 12 for communicating air to the fan 18. A passage inlet 36 (FIG. 8) feeds air into each of the passages 34. Preferably, the sum of the areas of the passage inlets 36 is larger than the area of the front air outlet 20. It has been discovered that providing air inlets 36 having a cumulative total area larger than the air outlet 20 is advantageous in achieving fan and motor operating efficiency and in reducing noise. It is also noted that providing too large of total air intake size may lead to undesirable increased noise emission accompanied by little or no appreciable gain in operating efficiency. A desired total intake area will therefore be greater than the outlet area and less than a desired maximum that is balanced against increased noise emission and determined through experiment.

Although two air inlets 36 and two passages 34 are provided with the dryer 10, it will be appreciated that other embodiments of the invention may have other numbers of passages 34 and inlets 36. For example, a different embodiment may have only a single passage 34 and inlet 36, while still other embodiments may have a single passage 34 that has a plurality of inlets 36 or a single inlet that feeds a plurality of individual passages.

Referring once again to FIGS. 7–8, the passages 34 communicate with a chamber 38 defined between the fan intake 24 and the shroud end cap 32. Preferably, the chamber 38 communicates with substantially all of the fan intake 24 and has a generally umbrella-shaped back wall 40 defined by the shroud end cap 32. A central support 42 is provided near the center of the generally circular shroud end cap 32, and has a throughbore 44 that cooperates with a body throughbore 46. One or more supporting ribs may be provided for supporting the central support. A fastener (not shown) such as a bolt or screw passing through the two throughbores 44 and 46 attaches the shroud end cap 32 to the body 12. Other fastener means are contemplated, including but not limited to rivets and adhesives. Generally arcuate walls 50 extend radially outward from the center support 42 to give the wall 40 its general umbrella shape. An outer rim 33 of the shroud end cap 32 engages the back end 26 of the body 12.

It has been discovered that this preferred umbrella shaped wall 40 provides valuable advantages for the dryer device 10. In particular, the arcuate profile of the wall 40 helps to define a gradually bending, arcuate flow path in the chamber 38 for air that is flowing from the passages 34 to the fan intake 24. This arcuate flow path helps to minimize flow disturbances upstream of the fan intake 24, and thereby allows the motor 16 and the fan 18 to operate more efficiently and quietly than when flow disturbances such as sharp turns and the like are present. A separation distance between the wall 40 and the fan intake 24 may vary to suit the size and/or speed of the fan motor 16, the configuration of the fan 18 and the shape of the body 12.

Additionally, the configuration of the chamber 38 allows for substantially all of the useful area of the fan intake 24 to remain unobstructed for communication with the chamber 38, since the central support 42 and its supporting ribs take up a relatively small portion of the overall area of the intake 24. Accordingly, airflow into the fan 18 occurs over substantially all of the area of the intake 24. This further contributes to efficiency of the motor 16 and the fan 18 and reduces noise.

The preferred shroud 30 further includes a decorative end cover 52 for covering the exterior of the shroud end cap 32. The end cover 52 has a general dome shape and may be conveniently snap fit onto the shroud end cap 32 using tabs 54 so that its exterior surface appears smooth and free from screw heads or other fasteners.

Figure 2:
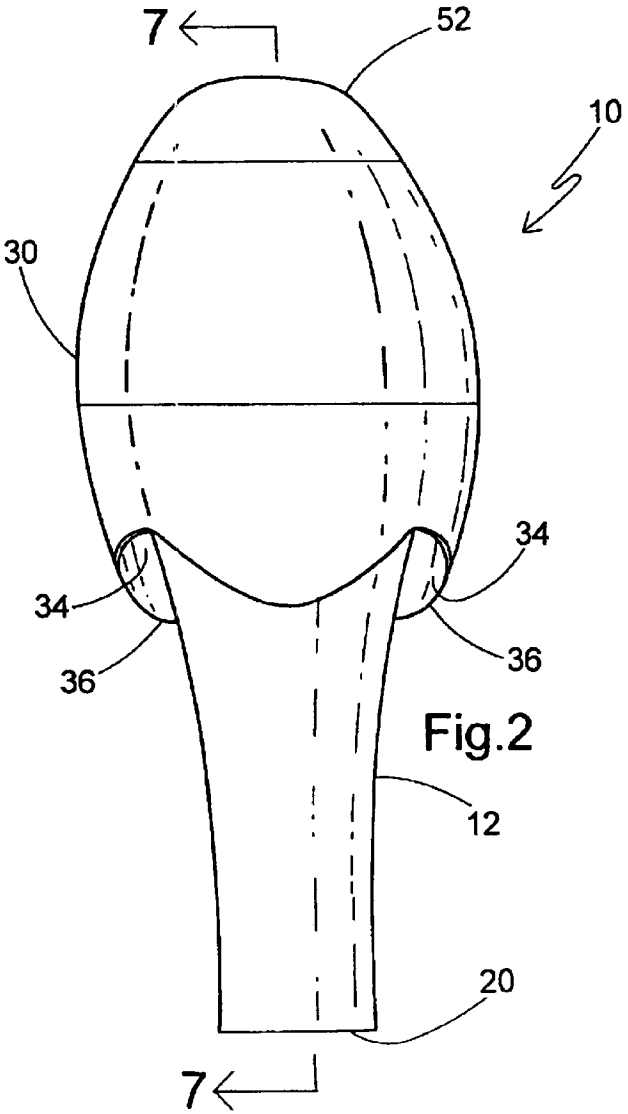
FIG. 2 is a top view of the drying device of FIG. 1.
Figure 1:
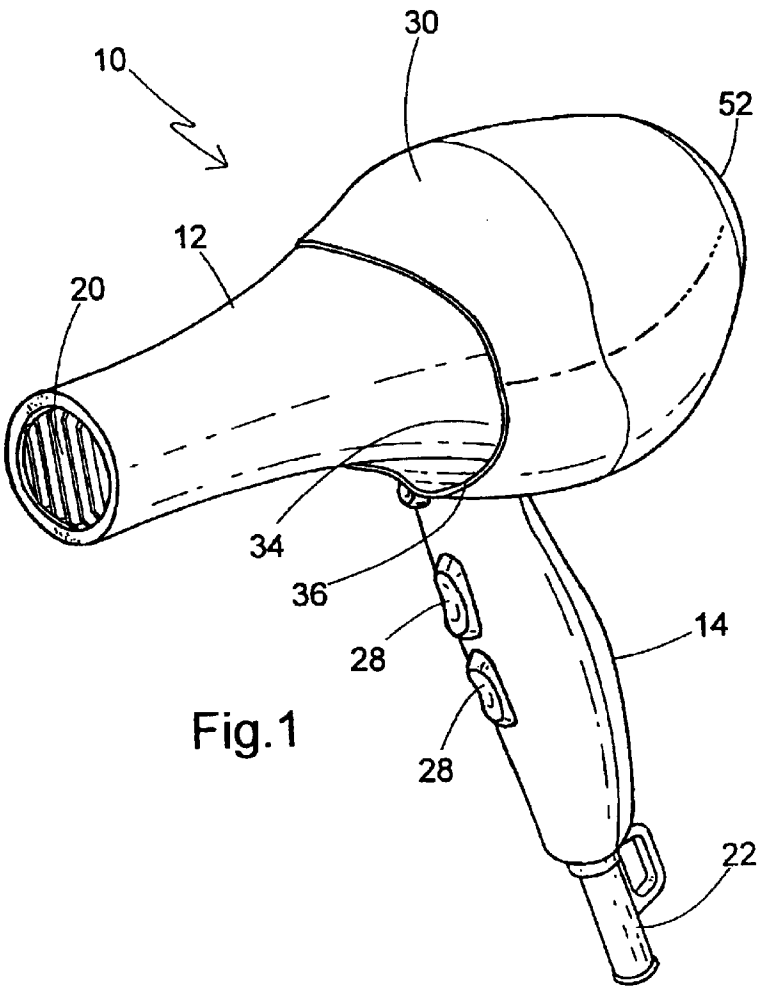
FIG. 1 is a perspective view of a preferred embodiment of the present hand held drying device.
Figure 4:
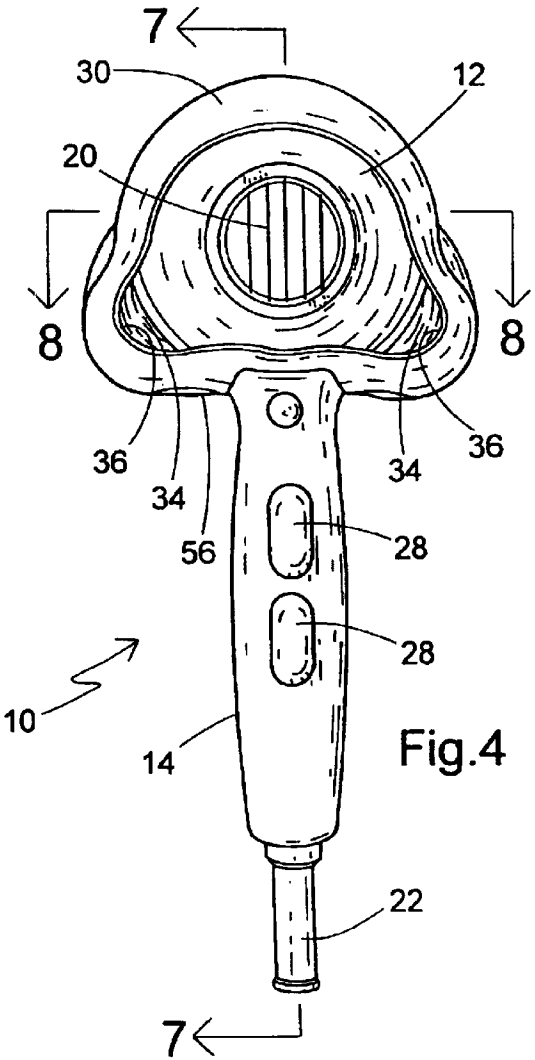
FIG. 4 is a front view of the drying device of FIG. 1.
Figure 6:
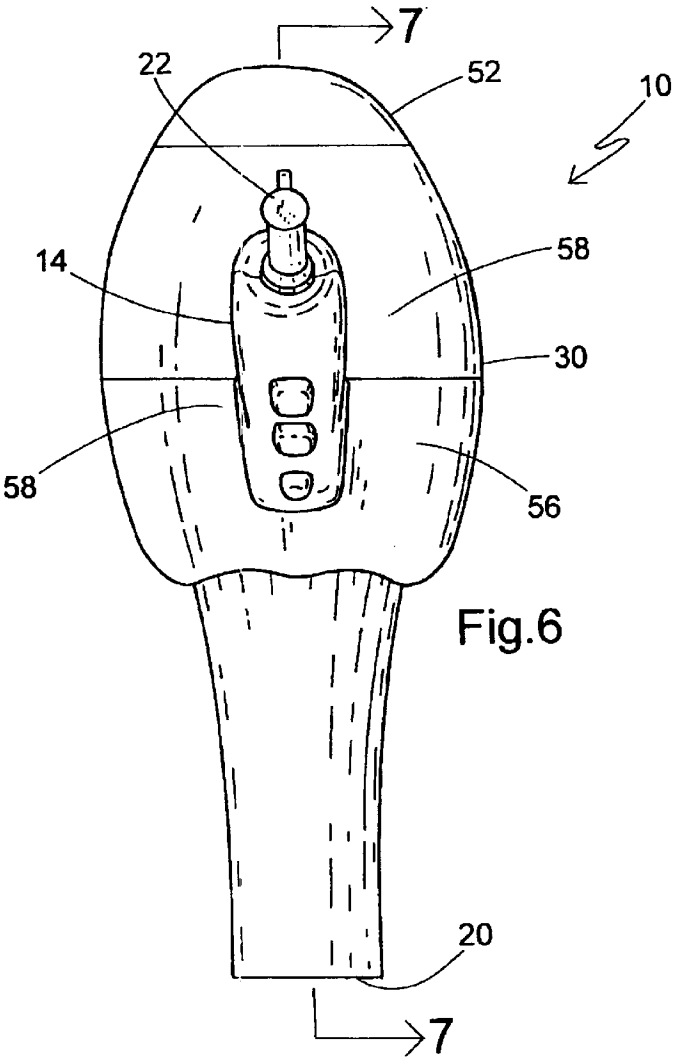
FIG. 6 is a bottom view of the drying device of FIG. 1.
Figure 5:
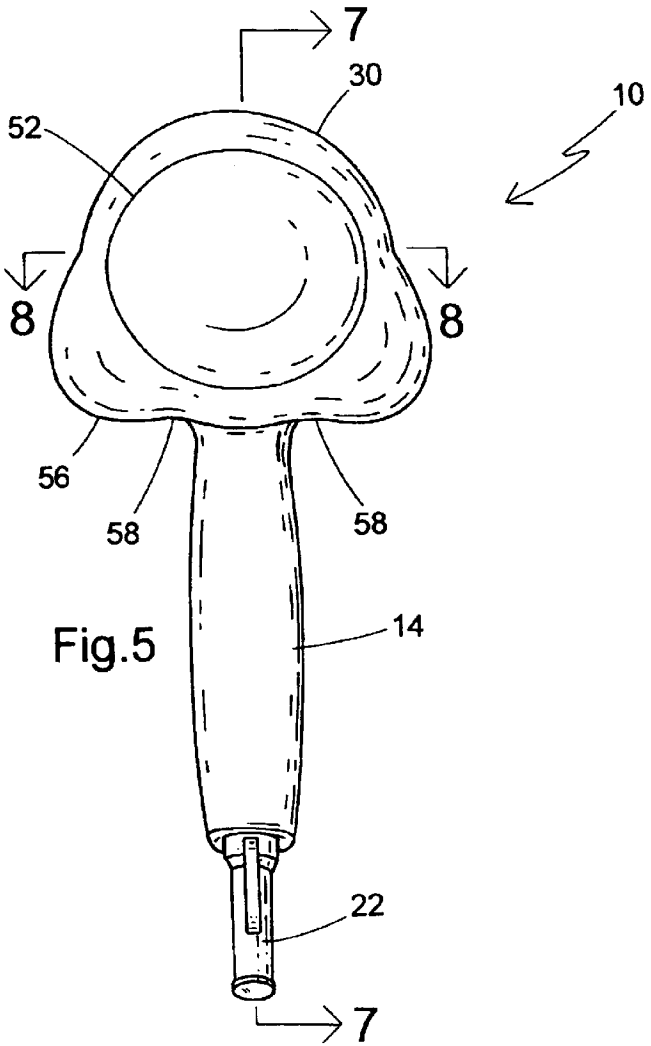
FIG. 5 is a rear view of the drying device of FIG. 1.

As best illustrated by FIGS. 4–6, the shroud 30 has a generally planar bottom portion 56 that is ergonomically configured for more comfortable gripping. This design factor is desirable for professional stylists and others who grip the handle 14 for long periods. In the preferred embodiment, the bottom part 56 is provided with at least one and preferably two elongate recesses or depressions 58 for engaging a user's hand as it grips the handle 14. Preferably, one of the depressions 58 is disposed on each side of the handle 14, and the depressions 58 are connected at their rear to one another.

The depressions 58 allow the shroud 30 to rest comfortably in a user's hand, and are preferably located in operational relationship to the handle 14 for facilitating comfortable long term gripping. This configuration allows the top of a user's hand to comfortably support the body 12 at a point where its weight is generally centered due to the proximity of the motor 16 and the fan 18. The precise disposition and configuration of the depressions 58 may vary to suit the application.

Ergonomics of the preferred dryer 10 are further enhanced by attaching the handle 14 at an oblique angle to the body 12. In particular, the handle 14 is preferably attached a central axis A of the handle 14 oriented to a central axis B of the body 12 at an oblique angle θ that is most preferably between about 60° and about 80°, as illustrated in FIG. 3.

Other configurations and locations for the air inlets 36 are also possible. As an example, a single air inlet 36 could be provided that covered a substantial portion, or even all, of the perimeter of the body 12. That is, an embodiment could have a shroud 30 spaced apart from the body 12 about substantially all of the body perimeter. Also, other embodiments may include a shroud 30 that extends further forward to terminate closer to the air outlet 20. In this embodiment, air inlets 36 may be provided closer to the outlet 20. More rearward placement is preferred, however, for several reasons.

For example, if the inlets 36 are too close to the outlet 20, interference with the expelled air stream may occur, with the result that the outflow is partially misdirected or otherwise disturbed. More forward placement of the inlets 36 also increases the risk that a user's hair or other objects that are being dried may be drawn into the outlet 36. Finally, the overall length of the passage 34 effects the pressure loss of air as it travels through the passage 34, with the result that shorter passages 34 generally are favored to provide lower pressure losses and more efficient and quiet operation of the motor 16 and the fan 18. Most preferably, the air inlets 36 are spaced from the outlet 20 by a distance of about 5–7 inches, and preferably at least 5 inches.

Those skilled in the art will appreciate that the preferred embodiment described herein has been discussed for illustration purposes only. Other embodiments are of course possible within the scope of the invention. Indeed, those knowledgeable in the art will recognize equivalents to elements of the described preferred embodiment that are within the scope of the claimed invention. By way of example, although a hand held drying device in the form of a hand held hair dryer has been described herein, it will be understood that other invention embodiments may be directed to other drying devices.

Various features are set forth in the appended claims.

What is claimed is:

1. A hand held dryer device comprising:

a generally tube shaped body having a front air outlet for expelling air, said front air outlet having an outlet area, said body containing a motor and a fan driven by said motor for urging air towards said front air outlet, said body containing a heater for heating said air and having a back end; and, a shroud surrounding at least a portion of said body and covering said body back end, at least one passage defined between said shroud and said body, said passage having at least one passage inlet for communicating air to said fan, said at least one passage inlet having an area larger than said front air outlet area, and said shroud terminating a distance of at least about 5 inches from said front air outlet.

2. A hand held dryer device comprising:

a body having a front air outlet for expelling air, said front air outlet having an outlet area, said body containing a motor and a fan driven by said motor for urging air towards said front air outlet, said body containing a heater for heating said air, said fan having an intake defining an area; and, a shroud covering at least a portion of said body, at least one passage defined between said shroud and said body, said passage having at least one passage inlet for communicating air to said fan, said at least one passage inlet having an area larger than said front air outlet area, said shroud having an end cap defining an interior chamber communicating with substantially all of the area of said fan intake, said at least one passage communicating with said chamber, said end cap generally umbrella-shaped with a central support configured for attachment to said body and an arcuate wall extending radially outward from said central support to partially define said chamber.

3. A hand held dryer as defined by claim 2 wherein said shroud further comprises a generally dome-shaped end cover for attaching to said end cap.

4. A hand held dryer as defined by claim 2 wherein said end cap has a throughbore and said body has a body tbroughbore cooperating with said end cap throughbore, a fastener is provided passing through said end cap throughbore and received in said body throughbore to removably attach said end cap to said body, and said generally dome shaped cover is configured to snap fit to said end cap and cover said fastener.

5. A hand held dryer device comprising:

a body having a front air outlet for expelling air, said front air outlet having an outlet area, said body containing a motor and a fan driven by said motor for urging air towards said front air outlet, said body containing a heater for heating said air;

a shroud covering at least a portion of said body, at least one passage defined between said shroud and said body, said passage having at least one passage inlet for communicating air to said fan, said at least one passage inlet having an area larger than said front air outlet area, said shroud having a generally flat bottom portion with two elongate recesses that are connected to one another at an end; and, a handle attached to said body and proximate to said shroud generally flat bottom portion with one each of said two recesses disposed on one lateral side of said handle.

6. A hand held dryer comprising:

a body having a front air outlet and a back end, said body containing a fan, a fan motor and a heater, said fan having an intake with an area, said body having a throughbore;

a handle connected to said body;

a shroud covering at least a portion of said body, at least one passage defined between said shroud and said body for communicating air to said fan, said shroud having an end cap covering said body back end, a chamber defined between said end cap and said fan intake and communicating with said passage whereby air from said passage may enter said fan intake over substantially all of its area, said chamber having a back wall defined by said end cap, at least a portion of said back wall being generally arcuately shaped, said end cap generally umbrella shaped and having a central support for attaching to said body, said generally arcuate back wall portion extending radially outward from said central support, said central support having a throughbore; and, a fastener extending through said central support throughbore and received in said body throughbore to attach said end cap to said body.

7. A hand held dryer comprising:

a body having a front air outlet and a back end, said body containing a fan, a fan motor and a heater, said fan having an intake with an area;

a handle connected to said body;

a shroud covering at least a portion of said body, at least one passage defined between said shroud and said body for communicating air to said fan, said shroud having an end cap covering said body back end, a chamber defined between said end cap and said fan intake and communicating with said passage whereby air from said passage may enter said fan intake over substantially all of its area, said chamber having a back wall defined by said end cap, at least a portion of said back wall being generally arcuately shaped; and, a generally dome-shaped end cover for covering said end cap, said end cover configured to snap fit onto said end cap.

8. A hand held dryer device comprising:

a body having a front air outlet for expelling air, said front air outlet having an outlet area, said body containing a motor and a fan driven by said motor for urging air towards said front air outlet, said body containing a heater for heating said air;

a shroud covering at least a portion of said body, at least one passage defined between said shroud and said body, said passage having at least one passage inlet for communicating air to said fan, said at least one passage inlet having an area larger than said front air outlet area, said shroud having a generally flat portion with at least one elongate depression; and, a handle attached to said body proximate to said shroud generally flat bottom portion and in operational relationship to said at least one elongate depression.

9. A hand held dryer as defined by claim 8 wherein said body is generally tube-shaped, and wherein said shroud surrounds at least a portion of said generally tube-shaped body.

10. A hand held dryer comprising:

a body having a front air outlet and a back end, said body containing a fan, a fan motor and a heater, said fan having an intake with an area;

a handle connected to said body; and, a shroud covering at least a portion of said body, at least one passage defined between said shroud and said body for communicating air to said fan, said shroud having a generally umbrella shaped end cap covering said body back end, said end cap having a central support for attaching to said body, a chamber defined between said end cap and said fan intake and communicating with said passage whereby air from said passage may enter said fan intake over substantially all of its area, said chamber having a back wall defined by said end cap, at least a portion of said back wall being generally arcuately shaped and extending radially outward from said central support.

11. A hand held dryer device comprising:

a generally tubular body having a front air outlet for expelling air, said front air outlet having an outlet area, said body containing a motor and a fan driven by said motor for urging air towards said front air outlet, said body containing a heater for heating said air;

a handle connected to said body; and, a shroud covering at least a portion of said generally tubular body and being generally coaxial with said generally tubular body, at least one passage defined between said shroud and said body, said at least one passage generally coaxial with said body and having at least one passage inlet for communicating air to said fan, said passage inlet configured to provide a generally smooth flow pattern that is free from sharp turns, said at least one passage inlet having an area larger than said front air outlet area and being spaced back from said front air outlet, wherein said at least one passage inlet is axially spaced from said front air outlet by a distance of at least about 5 inches.

* * * * *